US005248127A

United States Patent [19]

Young

[11] Patent Number: 5,248,127

[45] Date of Patent: Sep. 28, 1993

[54] BOARD PRESS

[76] Inventor: Richard L. Young, 100 Rte. 87, Columbia, Conn. 06237

[21] Appl. No.: 843,612

[22] Filed: Feb. 28, 1992

[51] Int. Cl.[5] ..... B66F 3/00

[52] U.S. Cl. ..... 254/15

[58] Field of Search ..... 254/11, 15-17, 254/120, 113, 131; 29/267, 273

[56] References Cited

U.S. PATENT DOCUMENTS

| | | | |
|---|---|---|---|
| 32,120 | 4/1861 | Clough . | |
| 281,968 | 7/1883 | Caywood | 254/15 |
| 332,197 | 10/1885 | Goodhue . | |
| 338,933 | 3/1886 | Cloyd | 254/15 |
| 1,494,269 | 5/1924 | Meyers | 29/273 |
| 1,801,810 | 4/1931 | Goodson . | |
| 1,919,090 | 7/1933 | Busby . | |
| 2,188,819 | 1/1940 | Rich . | |
| 2,201,394 | 5/1940 | Edelblute . | |
| 2,208,883 | 7/1940 | Hall | 254/131 |
| 2,438,766 | 3/1948 | Rifenberg | 254/17 |
| 2,780,437 | 2/1957 | Ham . | |
| 4,621,791 | 11/1986 | Staskiewicz et al. | 254/17 |

FOREIGN PATENT DOCUMENTS 101779 of 1916 United Kingdom .

*Primary Examiner*—Robert C. Watson

*Attorney, Agent, or Firm*—Victor E. Libert; Frederick A. Spaeth

[57] ABSTRACT

A board press (10) comprises a dog member (12) dimensioned and configured to grip a joist (14*a*) and a lever (16) attached to one end to the dog member (12) by a ball and socket mounting (18) for pivoting of lever (16) about a pivot axis P—P. The ball and socket mounting (18) enables the pivot axis to be angularly displaced about a point on pivot axis P—P, thereby permitting the user to pivot the lever (16) perpendicularly to the edge (27) of a board (26*a*) being pressed despite twisting of the dog member (12) on the joist (14*a*) during use. A method of pressing one or more boards disposed on a joist includes using the board press and pivoting the lever in a pivot plane which is kept perpendicular to the edge of the board while simultaneously twisting the dog member to seat it upon the joist.

15 Claims, 5 Drawing Sheets

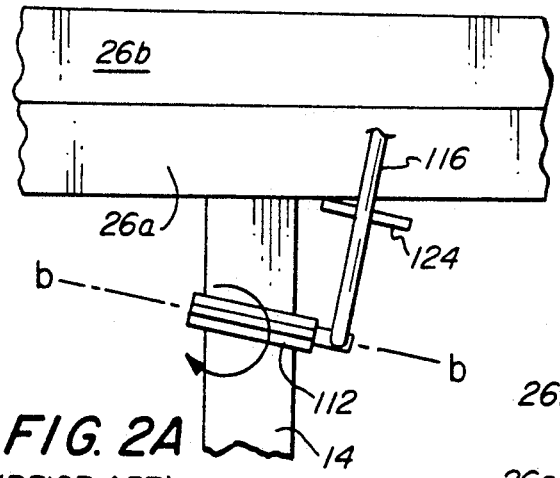
FIG. 2A
(PRIOR ART)
FIG. 2B
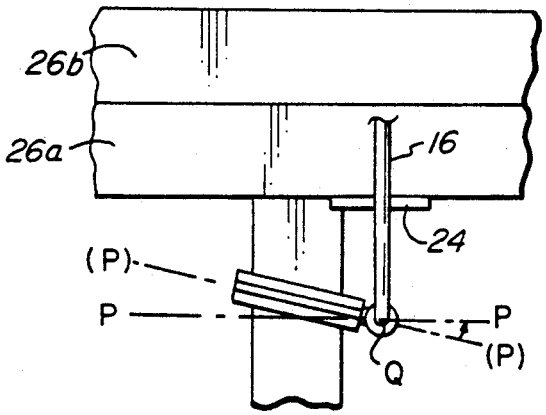
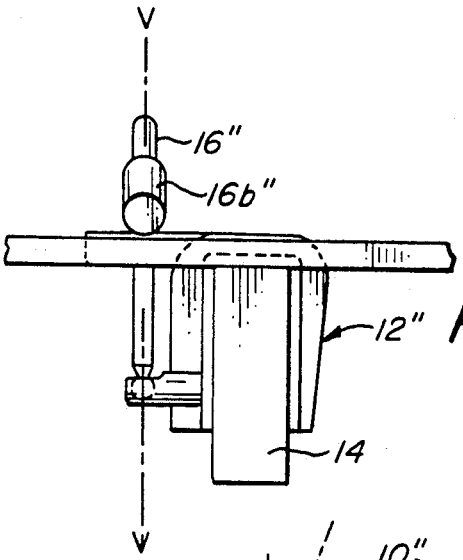
FIG. 5A
FIG. 5
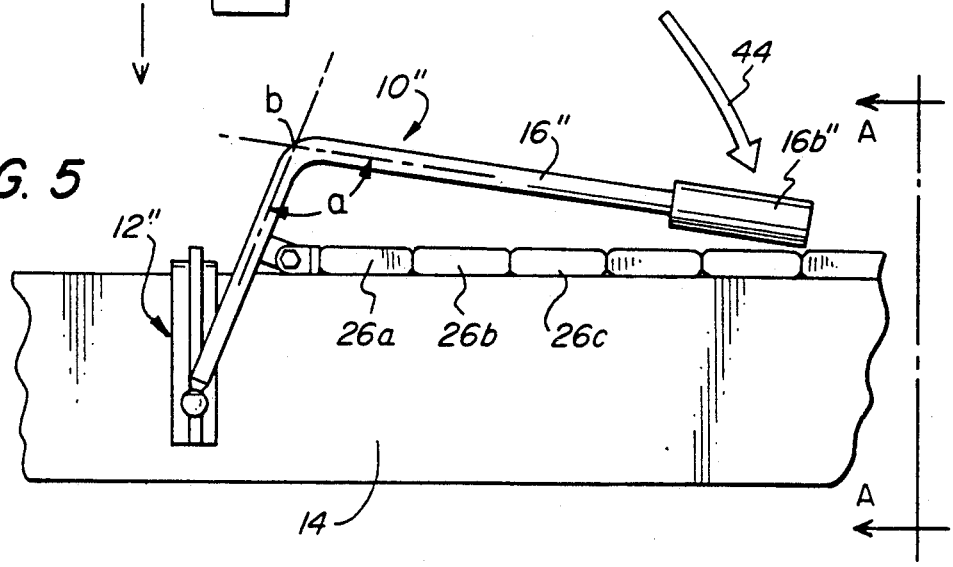

FIG. 4A
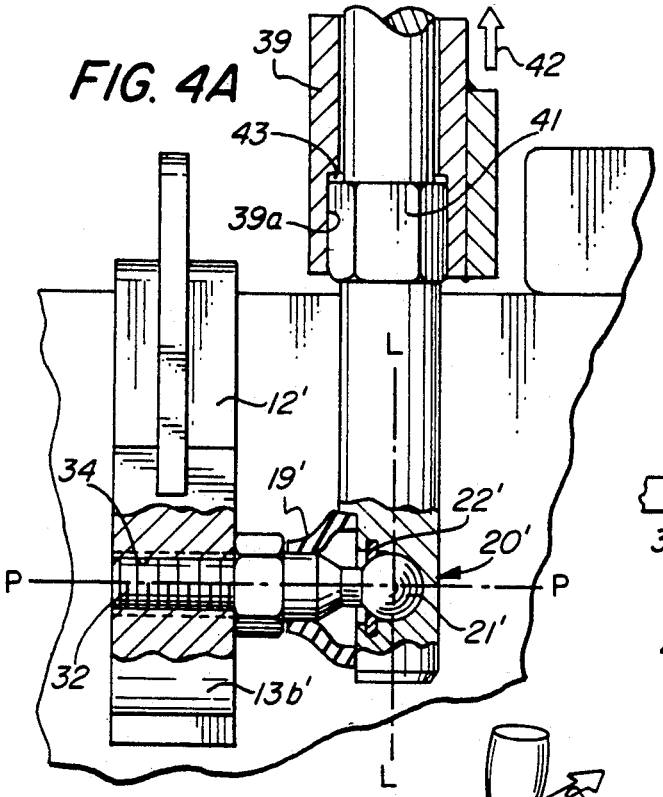
FIG. 4B
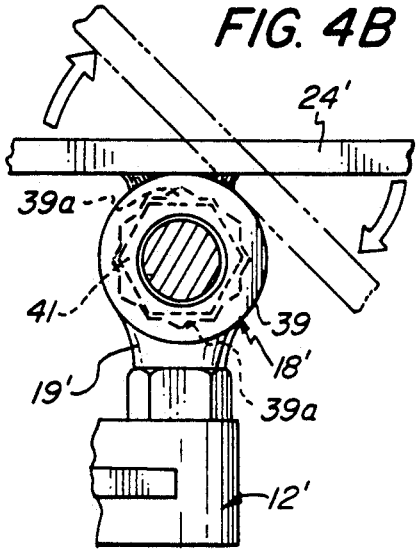
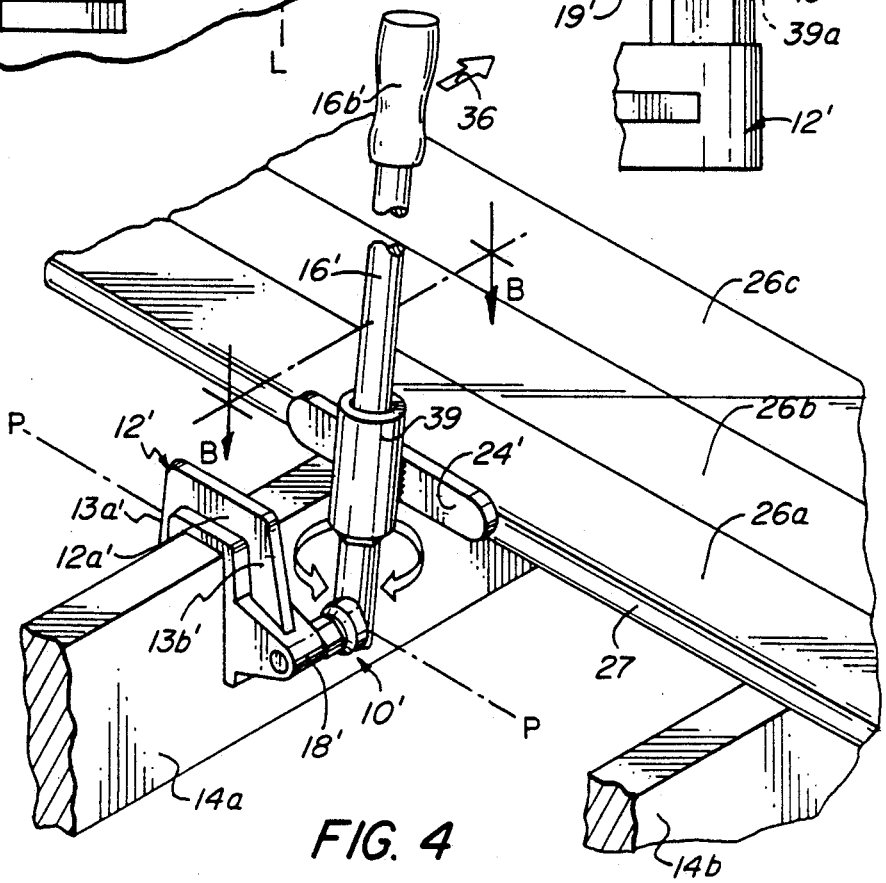
FIG. 4

BOARD PRESS

BACKGROUND OF THE INVENTION

1. Field of the Invention

This invention relates to construction tools, and specifically to board presses commonly used for pressing boards together.

2. Related Art

U.S. Pat. No. 701,784 to Arnold et al, dated Jun. 3, 1902, discloses a keying clamp comprising a handle 5 having an eye bolt 6 mounted at one end. A dog 3, adapted for gripping a joist from underneath (FIG. 4), is mounted to swivel on the ring of the eye bolt 6, so that the dog 3 may be positioned on either side of a joist. A locking bar serves to lock the device in position.

U.S. Pat. No. 668,573 to Beach dated Feb. 19, 1901, discloses a lumber pressing device comprising a lever attached to a U-shaped grip C by means of a connecting rod B. The grip C has upwardly extending legs and is seated beneath the joist in applying flooring lumber. The lever A may be oscillated about bolt D and connecting rod B may similarly oscillate about bolt E. Application of grip C from underneath would appear to require immediate application of at least enough force on lever A to hold the device in place.

U.S. Pat. No. 1,665,430 to Arzt dated Apr. 10, 1928, shows a floor jointing or tightening device comprising a lever 5 equipped on opposite sides with plates 6 which provide a bearing surface to bear against the floor boards laid on the joist. The lever is connected by means of a pin or pintle 9 for oscillating movement about a U-shaped gripping body 3.

U.S. Pat. No. 607,567 to Jordan dated Jul. 19, 1898, discloses a board clamp comprising a lever arm attached through chain linkage to a dog member.

U.S. Pat. No. 4,621,791 to Staskiewicz et al, dated Nov. 11, 1986, also discloses a board straightener comprising a lever arm pivotably mounted to a U-shaped saddle 12.

Despite the existence for many years of prior art such as described above, it is still standard practice in the construction industry to straighten boards by use of a pinch bar and temporary cleats, in a manner discussed below. Therefore, there is a need for an improved board press which is versatile and easy to use.

SUMMARY OF THE INVENTION

Generally, in accordance with the present invention there is provided a board press comprising a lever pivotably mounted on one leg of a U-shaped clamp or dog member. The dog member is twisted into seating engagement with the joist in reaction to a torquing force imposed on it by bringing the lever to bear against a board, and the lever is so mounted on the dog member so as to enable a user to maintain the orientation of the lever member in selected relation to the edge of a board being pressed, despite pivoting of the dog member on the joist during use.

Specifically, the present invention provides a board press comprising a dog member having spaced-apart legs dimensioned and configured to snugly straddle a joist, an elongate lever having a longitudinal axis and a contact section, which may comprise a press plate carried on the lever, for engaging an edge of a board carried on the joist, and mounting means pivotably connecting the lever to one of the legs of the dog member. The mounting means, which may comprise a ball and socket joint, allows pivoting of the lever relative to the dog member about a pivot axis provided by the mounting means, the pivot axis being angularly displaceable about a point on the pivot axis, whereby the plane through which the lever is pivoted to bring the contact section to bear against a board carried on the joist may be selected independently of the orientation of the dog member on the joist.

According to one aspect of the invention, the lever may be rotatable about its own longitudinal axis.

In another aspect of the present invention, the press plate may be pivotably mounted to the lever, to thereby allow the press plate to pivot about a press plate pivot axis which is substantially perpendicular to the longitudinal axis of the lever.

Another aspect of the present invention provides that the mounting means is connectible to opposite sides of the same leg of the dog member, whereby the lever can be selectively mounted on either side of the same leg of the dog member.

Still another aspect of the present invention provides that the press plate is rotatably mounted on the lever for rotation about the longitudinal axis of the lever. In a related aspect of the present invention, rotation indexing means serve to operatively engage the rotatably mounted press plate with the lever, whereby the press plate can be selectively fixed in a plurality of rotational orientations about the longitudinal axis of the lever.

In accordance with a method aspect of the present invention, there is provided a method for pressing one or more boards disposed on a joist. The method comprises engaging the joist with a board press comprising a dog member having spaced-apart legs dimensioned and configured to straddle a joist and to grip the joist upon pivoting of the dog member relative to the joist, and employing mounting means on one leg of the dog member to provide a pivoting motion for a lever having a contact section dimensioned and configured to engage a board disposed on the joist. The method further comprises pivoting the lever about a pivot axis provided by the mounting means so that the lever presses against a board, and simultaneously angularly displacing the pivot axis about a point on the pivot axis, to pivot the lever in a plane which remains substantially perpendicular to the edge of the board.

Another aspect of the present invention provides an improvement in a board press comprising a dog member having spaced-apart legs dimensioned and configured to snugly straddle a joist, a lever having a longitudinal axis and being pivotably mounted on the dog member for pivoting of the lever about the dog member to press a board on the joist, and a press plate dimensioned and configured to engage a board disposed on the joist. The improvement comprises that the press plate is mounted on the lever for rotation about the longitudinal axis thereof, whereby, upon pivoting of the lever about the dog member, the press plate may be rotated relative to the lever to maintain the press plate oriented in relation to the board despite pivoting of the dog member relative to the joist. In this embodiment of the invention, the board press may further include indexing means operatively connected between the press plate and the lever to releasably lock the press plate into a selected rotational position relative to the lever.

Use of the board press described in the immediately preceding aspect of the invention provides a method for pressing one or more boards disposed on a joist. This method comprises engaging the joist with a board press comprising (a) a dog member having spaced-apart legs dimensioned and configured to straddle a joist and to grip the joist upon seating movement of the dog member relative to the joist, and (b) an elongate lever mounted by a mounting means on one leg of the dog member, the lever having rotatably mounted thereon a press plate which is dimensioned and configured to engage a board disposed on the joist. The method comprises the steps of pivoting the lever about the dog member and rotating the press plate about the longitudinal axis of the lever whereby to maintain the press plate oriented in flush engagement with an edge of the board despite seating movement of the dog member relative to the joist.

Other aspects of the present invention are disclosed in the following description.

BRIEF DESCRIPTION OF THE DRAWINGS

FIG. 2A is a schematic plan view showing elements of a board press of the prior art during use;

FIG. 2B is a schematic plan view showing elements of a board press according to an embodiment of the present invention during use;

FIG. 4 is a perspective view corresponding to FIG. 1 but showing another embodiment of the present invention;

FIG. 4A is a side elevational view, on an enlarged scale with respect to FIG. 4 and partly in cross section, of a portion of the board press of FIG. 4;

FIG. 4B is a partial view taken along line B—B of FIG. 4 and showing in phantom outline a portion of the press plate being rotationally adjusted;

FIG. 5 is a schematic elevational side view of another embodiment of the present invention having a bent lever; and FIG. 5A is a view taken along line A—A of FIG. 5.

DETAILED DESCRIPTION OF THE INVENTION AND PREFERRED EMBODIMENTS THEREOF

The present invention relates to a board press for use in constructing floors, decks, walls and the like by attaching a plurality of boards or planks to spaced-apart joists. The lengthy planks used in such construction are rarely true, i.e., they are often somewhat warped or crooked, so that when laid side-by-side spaces are left between adjacent boards, as described below. To improve the quality of the floor, the workman typically forces the boards together with sufficient force to at least partially straighten them, so that edges of adjacent boards are contiguous and substantially straight. It is common practice for workmen to nail a cleat to a joist and, using the cleat as a fulcrum, to employ a pinch bar as a lever to press against the edge of the board to hold the board in place before nailing or screwing it onto the joist. This technique is usually employed to straighten warped or crooked boards but may also be used to impart a desired slight curve to the board being fastened. However, this technique is inconvenient and wasteful in that effort must be expended to attach the cleats to the joist, and the cleat must be removed and repositioned after each use. Further, it is usually possible to straighten or clamp only one or two boards in this manner because the use of a pinch bar on a cleat simply does not provide sufficient mechanical advantage to enable a person of ordinary strength to clamp or straighten more than one or two boards at a time.

Figure 1A:
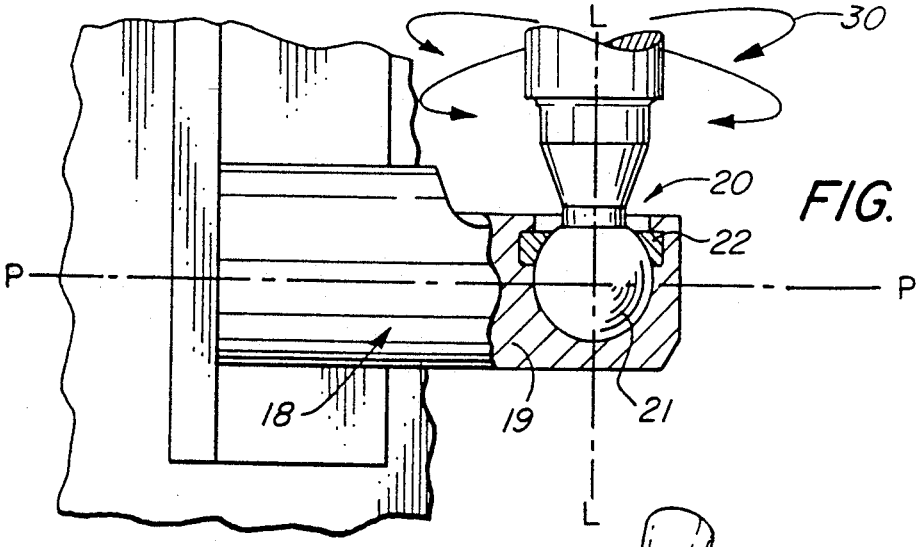
FIG. 1A is an elevational view on an enlarged scale with respect to FIG. 1, and partly in cross section, of the mounting means portions of the board press of FIG. 1.
Figure 1:
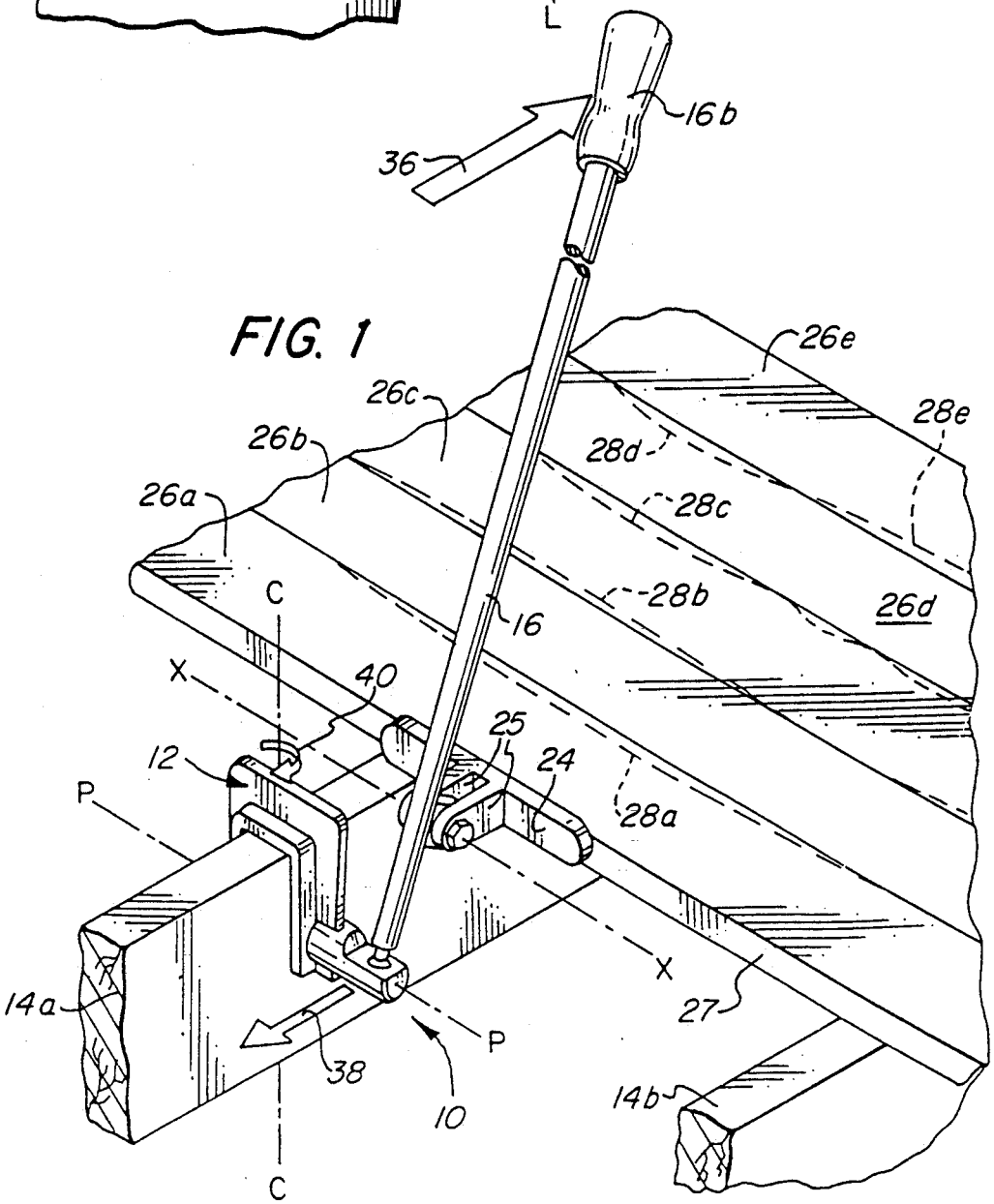
FIG. 1 is a perspective view of one embodiment of a board press according to the present invention and shows, with parts broken away, a typical use environment comprising a plurality of floor boards lying upon joists to which the boards are to be fastened.

The present invention provides a board press 10, FIG. 1, for use in pressing the edges of boards together. As illustrated in FIG. 1, the boards **26*a*–26*e* are disposed perpendicularly upon the joists, i.e., the longitudinal axes of the boards 26*a*–26*e* are perpendicular to the longitudinal axes of the joists 14*a*, 14*b*. Boards 26*a*, 26*b*, 26*c*, 26*d* and 26*e* rest on top of joists 14*a* and 14*b* in a conventional horizontal orientation, e.g., to provide a flooring surface. An edge 27 of board 26*a* faces device 10. Phantom lines 28*a*, 28*b*, 28*c*, 28*d* and 28*e* show the warped or crooked configuration of the edges of respective ones of boards 26*a* through 26*e* as they exist prior to pressing the boards with device 10. Such warped or crooked boards are especially prevalent in pressure-treated lumber commonly used for exterior construction such as decks and walk-ways. Board press 10 comprises a unitary, U-shaped clamp or dog member 12 comprising (FIG. 1C) a bight portion 12*a* and a pair of spaced-apart legs 13*a*, 13*b* extending from respective opposite ends of bight portion 12*a*. Dog member 12 is dimensioned and configured to snugly straddle a conventional floor joist 14*a* with legs 13*a* and 13*b* extending downwardly and engaging the two opposing, vertically disposed sides of joist 14*a***.

Figure 1C:
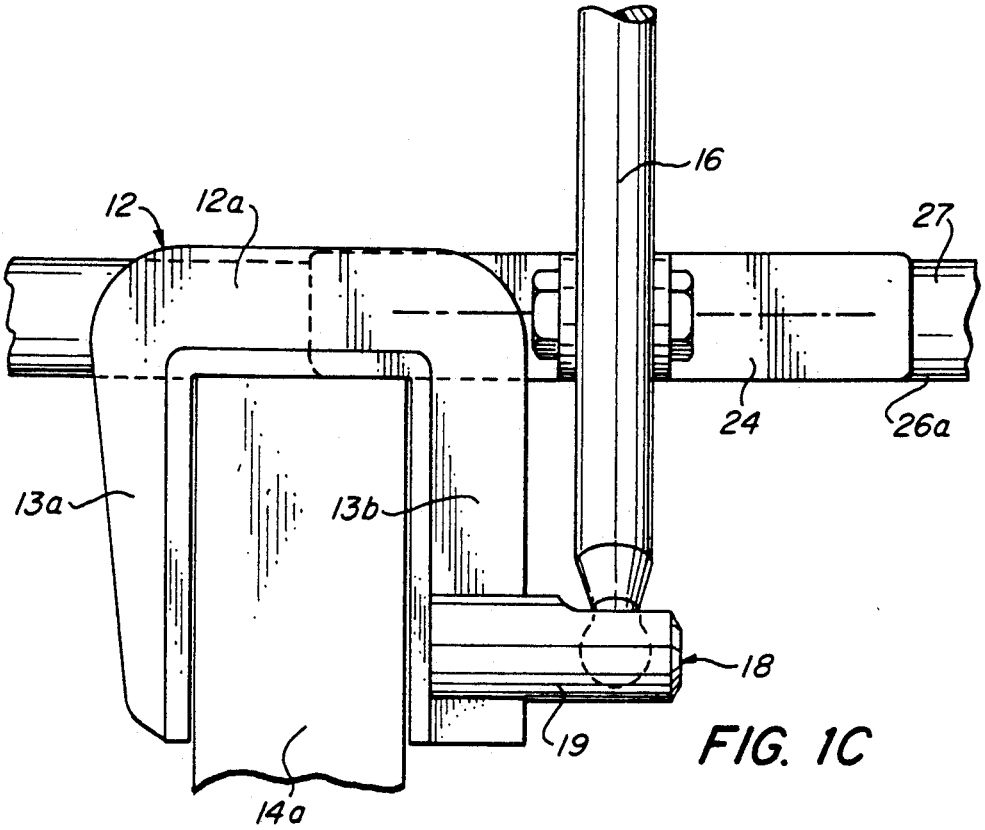
FIG. 1C is a partial elevational view along line C—C of FIG. 1B.

Referring now to FIGS. 1 through 1C, an upwardly extending lever 16 is attached at one end to leg **13*a* of dog member 12 by mounting means 18, which is described in more detail below. At its opposite, distal end, lever 16 is equipped with a handle 16*b*. Lever 16, a portion of the longitudinal axis L—L of which is shown in FIG. 1A, has a contact section which bears against the joist-supported board nearest to the device, i.e., board 26*a* in FIG. 1. Although the contact section could simply be a segment of lever 16, preferably, a press plate is provided as the bearing section. Thus, in the illustrated embodiment, the contact section is provided by press plate 24, which has a face 24*a* (FIG. 1B) and a pair of mounting arms 25 (FIGS. 1 and 1B) pivotably mounted to lever 16 by bolt 29 which passes through arms 25 of press plate 24 and stud 16*a* (FIG. 1B) of lever 16. Press plate 24 pivots about press plate pivot axis X—X (FIG. 1) so that the face 24*a* of press plate 24 substantially squarely engages the edge 27 of a board or plank such as floor board 26*a*, despite changes in the angular position assumed by lever 16 as the user manipulates lever 16 during use. This aspect of the operation of press plate 24** will be discussed further below.

Mounting means 18 is shown in more detail in FIG. 1A, where it is seen to comprise a mounting stud 19 which carries a conventional ball and socket joint 20 comprised of a ball member 21 and a socket member 22. In the illustrated embodiment, ball member 21 is fixed to that end of lever 16 which is mounted to dog member 12, by welding or any other suitable technique. Alternatively, ball member 21 may be integrally formed on the end of lever 16. Socket member 22 is formed within mounting stud 19 which is fixed to dog member 12, likewise by welding or any other suitable method, and so is stationary with respect to dog member 12. The ball and socket joint 20 defines a pivot axis P—P (FIGS. 1 and 1A) about which lever 16 pivots. By virtue of the ball and socket mounting of lever 16 to dog member 12, lever 16 is free not only to fully rotate about its own longitudinal axis L—L as indicated by arrows 30 in FIG. 1A, but to be pivoted in a selected plane independently of changes in the orientation of dog member 12 caused by twisting motion of dog member 12 on the joist 14*a*. Lever 16 pivots in a pivot plane (not shown) which is perpendicular to pivot axis P—P, but pivot axis P—P may itself rotate, or be angularly displaced, relative to the dog member 12 about a point on pivot axis P—P. This ability to change the angle at which pivot axis P—P is oriented relative to dog member 12 is referred to herein and in the claims as the pivot axis being "angularly displaceable" about a point on the pivot axis. Such angular displacement encompasses both substantially 360 degrees of rotation as is attainable with the embodiment of FIGS. 1-1C, and a more limited degree of rotation, i.e., oscillation, of the pivot axis about a point thereon, as is the case with the embodiment of FIGS. 4-4B described below. The term "angularly displaceable" therefore encompasses both full (360 degrees) rotation in both directions of the pivot axis about a point on itself and less than 360 degrees rotation, i.e., oscillation, about a point on itself. In the embodiment illustrated in FIGS. 1-1C, the point about which the pivot axis rotates is the intersection of pivot axis P—P with the longitudinal axis L—L of lever 16. In any case, in the embodiment illustrated in FIGS. 1-1C, the pivot axis P—P is angularly displaceable substantially 360 degrees, although dog member 12 would interfere with pivoting of lever 16 in some pivot planes. Because the pivot axis P—P is angularly displaceable, the user may pivot lever 16 in a pivot plane which may be selected independently of the orientation of the dog member 12 on the joist 14*a*. The user is therefore enabled to select a pivot plane for lever 16 which is and remains perpendicular to the edge 27 of floor board 26*a*, despite the twisting seating movement of dog member 12 on joist 14*a* during use. The present invention thus overcomes the tendency, found in many prior art devices and discussed below, of the lever "fighting" the operator as pressure is applied to the board to be straightened.

In use, the board press 10, FIG. 1, is seated upon joist 14*a* with lever 16 oriented so that before pressure is applied, press plate 24 rests squarely against edge 27 of floor board 26*a* and dog member 12 rests squarely on joist 14*a*. At this point, boards 26*a*, 26*b*, 26*c* and 26*d* lay flat, side-by-side on joists 14*a*, 14*b* (and other joists, not shown) but are not yet fastened to the joists. There are gaps between the respective edges of boards 26*a*-26*e*, as indicated by the dotted lines 28*a*-28*e* representing the unstraightened configurations of the edges of the boards. These gaps are present because the boards are curved in the horizontal plane of the floor and thus do not have straight edges. The user places the dog member 12 in place on joist 14*a* as shown, and applies pressure in the direction of arrow 36, pivoting lever 16 about pivot axis P, and forcing press plate 24 to press against edge 27 of floor board 26*a* while creating an equal but opposite reaction force against dog member 12, indicated by arrow 38. The reaction force imposes a torquing force about central axis C—C of dog member 12 (FIG. 1), as indicated by torque arrow 40, causing dog member 12 to pivot slightly about its central axis C—C so that legs 13*a*, 13*b* of dog member 12 firmly seat upon joist 14*a*, thus securing board present invention allows pivot axis P—P to be angularly displaced about longitudinal axis L—L relative to dog member 12, so that the user may pivot lever 16 in a selected plane which remains substantially perpendicular to edge 27, despite the seating movement of dog member 12. As the user further pulls lever 16 from the starting position shown in solid line in FIG. 1C, face 24*a* of press plate 24 bears against edge 27 of board 26*a*. As pressure is applied by pulling (or pushing) lever 16, board 26*a* is pressed against adjacent boards 26*b*-26*d*, straightening the boards and closing unwanted gaps between them. The boards may then be secured in place by nailing or screwing them to the joists. Of course, the invention may be used in this way not only to straighten boards, but to impart a controlled, desired curvature to them.

Figure 1B:
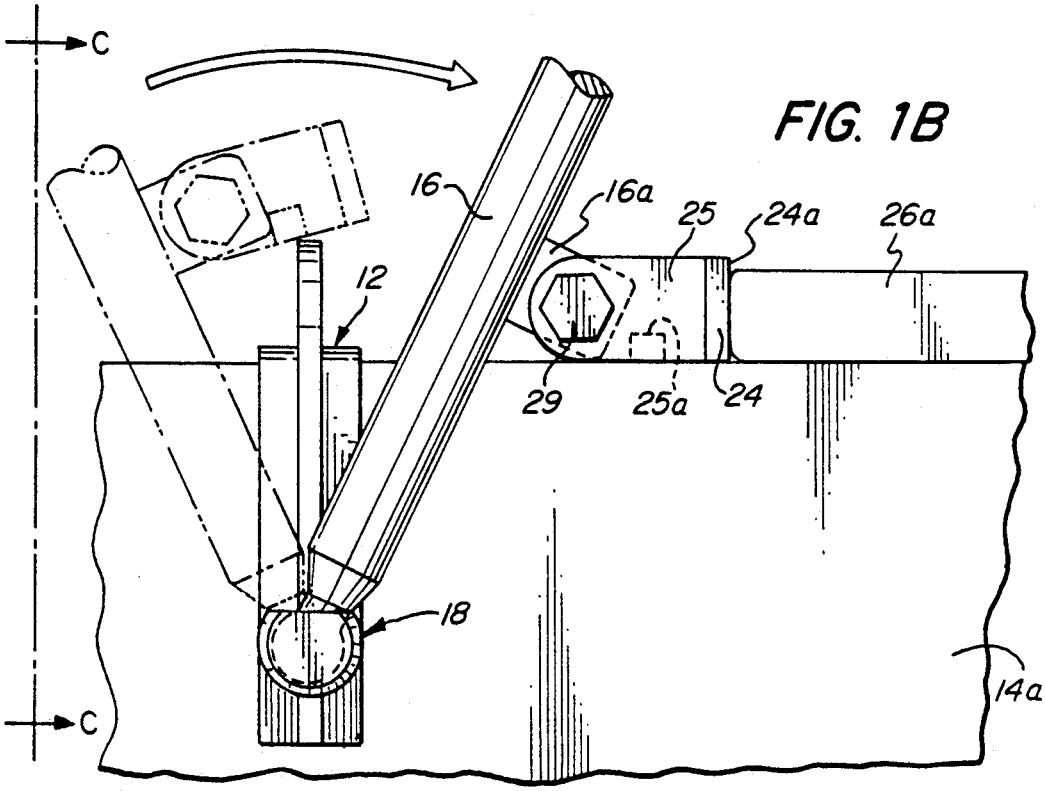
FIG. 1B is a side elevational view on a scale enlarged with respect to FIG. 1, of a portion of the board press of FIG. 1, showing the lever member in phantom outline in its starting position and in solid line in its extended pressing position.

Pivoting action of press plate 24 is well illustrated in FIG. 1B, which illustrates that press plate 24 can pivot during travel of lever 16 so that face 24*a* of press plate 24 is disposed squarely against edge 27 of board 26*a*, with press plate 24 riding on top of joist 14*a* so that flush and full engagement of edge 27 of board 26*a* is attained. This helps to apply force squarely to edge 27 and thereby enhances the mechanical efficiency of the pressing action. Pivot arms 25 also serve to displace the face 24*a* of pivot member 24 laterally of lever 16, so that press plate 24 can engage the edge of a board without the need to place dog member 12 immediately adjacent to the board. This helps to provide sufficient travel distance to obtain enough leverage or mechanical advantage to impose sufficient force on the boards to easily straighten and hold from one up to four or five or more boards at one time. This ability greatly enhances the speed with which the boards can be secured in place as compared to the maximum of one or two boards which can be set at one time by using a pinch bar and cleats. As the user pulls lever 16 forward, press plate 24 pivots about press plate pivot axis X—X (FIG. 1) to accommodate the change in angular orientation of lever 16 and align face 24*a* of press plate squarely against edge 27 of board 26*a*.

Boss 25*a*, shown in dotted outline in FIG. 1B, is located on the interior of one or both of arms 25 of press plate 24, to engage stud 16*a* on lever 16, as best seen in the phantom outline rendition of lever 16 in FIG. 1B, to prevent press plate 24 from "drooping" low enough to engage the bight section 12*a* of dog member 12 when lever 16 is approaching or passing through the midpoint of its travel from the phantom outline to the solid line positions in FIG. 1B.

Prior art devices, such as some of those described above, comprise a U-shaped clamp or dog member designed to be seated on the joist and having a pivotable lever affixed to one leg of the joist. The lever is pivoted relative to the joist, imparting a twisting movement to the dog member which seats the dog member on the joist, and the lever or a plate carried on the lever presses against the edge of the board. A difficulty with such devices which utilize a pin or pintle about which the lever is pivoted relative to the clamp or dog member, is that as the clamp or dog member twists to seat itself upon the joist, the plane of pivoting of the lever is twisted out of perpendicular alignment with the edge of the board being straightened. While the twisting movement of the dog member on a joist is small, the user experiences difficulty in controlling the lever because the pressure applied by the operator, enhanced by the mechanical advantage afforded by the lever, resists the attempts of the operator to bring the lever to bear squarely and perpendicularly against the board being pressed. The more pressure applied by the operator, the more the lever tends to "fight" the operator with respect to the direction in which the operator wishes to force the lever against the boards. In contrast, the device of the present invention permits smooth and easy accommodation of the twisting or seating action of the dog member (12 in FIGS. 1-1C) so that the user may readily maintain the lever in a desired pivoting plane which is substantially perpendicular to the edge of the board being contacted by the device, despite the twisting or seating movement of the dog member. As schematically illustrated in FIG. 2A, with devices typical of the prior art the pivoting of dog member 112 about the joist 14 would force lever 116 to turn, forcing the pivot plane of lever 116 to a non-perpendicular orientation in relation to edge 27 and causing the lever 116 to "fight" the efforts of the user to pivot the lever in a pivot plane which is perpendicular to the edge 27 of the board 26*a*. In addition, because the lever 116 is constrained to pivot in a pivot plane which is perpendicular to the bight axis b—b of dog member 112, press plate 124 is displaced so that it no longer rests squarely against edge 27 of floor board 26*a*. As a result, the pressure applied by the user is concentrated on the edge of press plate 124, which is in contact with edge 27, causing indentations or other stress-related flaws in board 26*a*. These are problems associated with a prior art device such as that shown by Arzt in U.S. Pat. No. 1,655,430. In the prior art device shown in U.S. Pat. No. 668,573 to Beach, lever A pivots about a pivot axis defined by bolt D at one end of linkage B, and the pivot axis orbits about an axis defined by bolt E at the other end of linkage B, which is remote from the pivot axis. On the other hand, the device shown in U.S. Pat. No. 701,784 to Arnold et al shows a dog 4 mounted on eyebolt 6, the center of which is offset from the longitudinal axis of lever 5. Therefore, if eyebolt 6 moves through dog 4, lever 5 will appear to orbit about a point at the center of the eye. Since this point is remote from the longitudinal axis of the lever, the operation of this device is similar to that of lever A in U.S. Pat. No. 668,573 to Beach. Neither Beach nor Arnold enables angular displacement of the pivot axis of the lever about a point on itself, which enables smooth and efficient operation of the device of the present invention.

In contrast, as shown in FIG. 2B, a board press of the present invention comprises a mounting means which allows lever 16, by virtue of its angularly displaceable pivot axis, to accommodate the rotation of dog member 12 relative to lever 16 so that the lever does not "fight" the user's attempt to pivot it in a selected pivot plane perpendicular to the edge 27 of board 26*a*. This is so whether board 26*a* is set perpendicularly or diagonally on the joists. Further, the angular displacement of the pivot axis of the mounting means of the present invention, allows press plate 24 to remain squarely against edge 27 of board 26*a*, as described above and as schematically illustrated in FIG. 2B. One embodiment of the present invention provides for the press plate to be rotatable about the longitudinal axis of the lever, to accommodate those embodiments of the invention wherein the pivot axis has only limited, or no, ability of angular displacement. In any case, with respect to the embodiment illustrated in FIG. 2B, the original orientation of pivot axis P—P relative to dog member 12 changes to that shown in FIG. 2B as (P)—(P) as the dog member 12 is twisted into seating engagement on joist 14, the pivot axis being angularly displaced about a point on the pivot axis so that lever 16 can be pivoted in a pivot plane which remains perpendicular to the edge 27 of board 26*a*. The point on axis P—P about which the angular displacement takes place is, in the illustrated embodiment, that point which is intersected by longitudinal axis L—L (shown as point Q in FIG. 2B of lever 16. Longitudinal axis L—L is perpendicular to and intersects the pivot axis P—P. Smooth operation is also enhanced by the ability of the lever of a device in accordance with an embodiment of the present invention to rotate about its own longitudinal axis.

Figure 3:
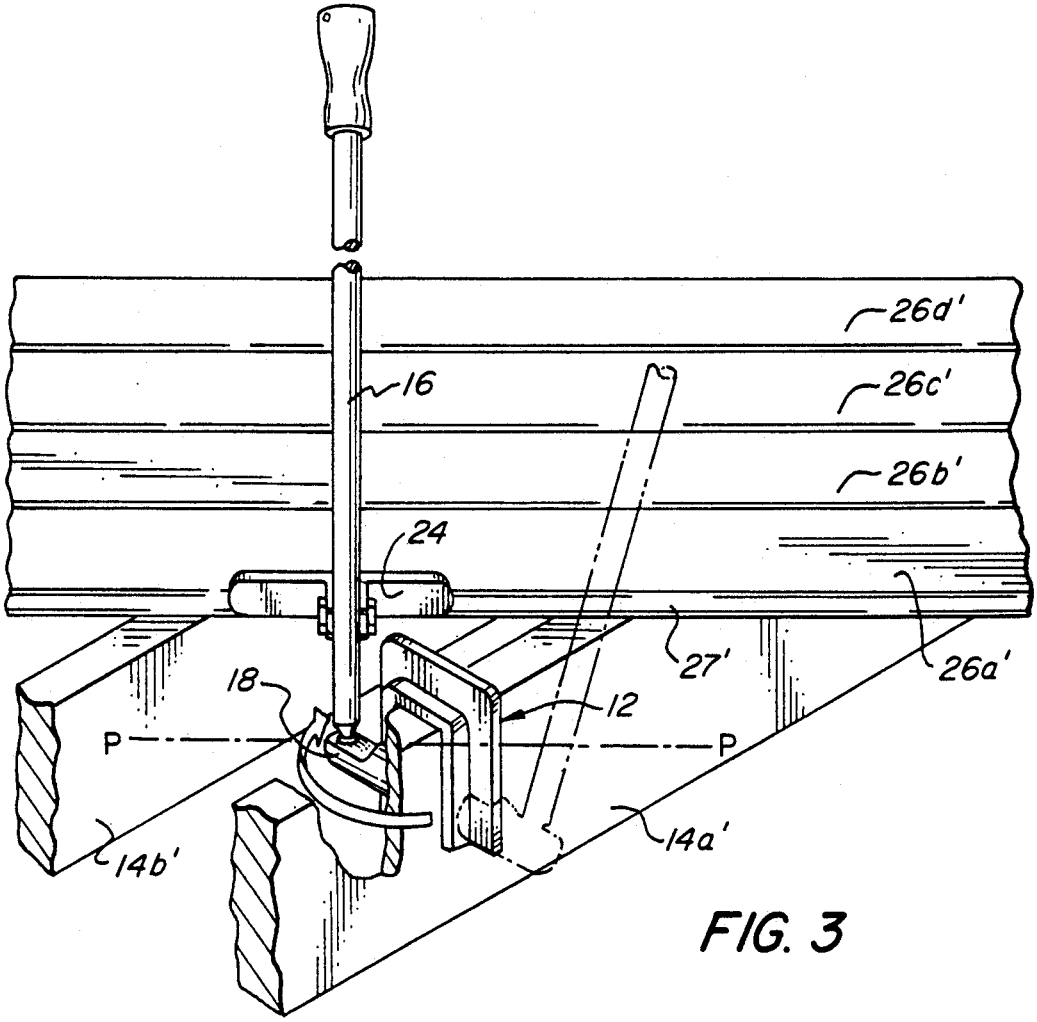
FIG. 3 is a perspective view similar to FIG. 1 showing the board press of FIG. 1 but in a use environment different from that of FIG. 1.

The device of the present invention is also useful in arrangements, such as that illustrated in FIG. 3, in which the boards are positioned diagonally with respect to the joists. The angular displacement characteristic of the pivot axis of lever 16 provides the option (illustrated in FIG. 3) of reversing the position of dog member 12 on the joist (14*a*' in FIG. 3) so that mounting means 18 is disposed on the opposite side of the joist from that shown in FIG. 1. The location of lever 16 prior to reversing the orientation of the device from that shown in FIG. 1, is shown in phantom outline in FIG. 3. As shown in FIG. 3, the boards 26*a*'-26*d*', are disposed posed diagonally upon the joists, i.e., the longitudinal axes of the boards 26*a*'-26*d*' are disposed at a non-perpendicular angle to the longitudinal axes of the joists 14*a*', 14*b*'. Press plate 24 is faced in the desired direction towards boards 26*a*', 26*b*', 26*c*', and 26*d*' by simply rotating lever 16 about its longitudinal axis L—L. In other embodiments, press plate 24 may be rotatable about lever 16, as discussed below, to accommodate different orientations of the boards relative to the joists. This may be useful when there is an obstruction near one side of the joist which prevents the disposition of mounting means 18 on that side, or to accommodate the different positions preferred by left-handed and right-handed users. The ability of lever 16 to pivot about a pivot axis P—P which is angularly displaceable relative to dog member 12, not only enables the user to effortlessly keep the pivot plane of lever 16 perpendicular to the edge of the boards being pressed, but enables pressing boards which are disposed diagonally with respect to the supporting joists. Thus, in FIG. 3, the lever 16 is turned to select a pivot axis P—P which, as illustrated, is parallel to the edge 27' of board 26*a*' so that the pivot plane through which lever 16 is pivoted is substantially perpendicular to the edge 27' of board 26*a*'. This pivot plane may be selected and maintained without "fighting" the twisting, seating motion of dog member 12. It is apparent that the device of the present invention may thus accommodate any angle at which the longitudinal axes of the floor boards are placed relative to the longitudinal axes of the supporting joists.

FIG. 4 illustrates an alternate embodiment of the present invention shown in the same use environment as illustrated in FIG. 1, wherein boards 26*a*, 26*b* and 26*c* are shown as carried on joists 14*a*, 14*b*. In this embodiment, a board press 10' has a lever 16' (shown broken-away) having a handle 16*b*' at its free end and attached to leg 13*b*' of dog member 12' by mounting means 18', which comprises a ball and socket joint carried on a mounting stud 19' which extends perpendicularly of the plane in which dog member 12' lies, instead of parallel thereto as in the case of the embodiment of FIGS. 1-1C. Board press 10' also comprises an indexable press plate 24', which will be described in further detail below. The ball and socket joint 20' of FIG. 4 is shown in more detail in FIG. 4A, wherein it is seen that ball member 21' is fixed to leg 13*b*' of dog member 12' by being mounted on ball post 32 which is threaded and screwed into a tapped, open ended bore 34 on leg 13*b*' of dog member 12'. A socket member 22' is integrally formed in lever 16' to receive ball member 21'. Ball and socket joint 20' defines a pivot axis P—P which is displaced from dog member 12' by virtue of mounting means 18' extending perpendicularly of the plane defined by the major dimensions of dog member 12', i.e., perpendicularly of the common plane in which legs 13*a*', 13*b*' and bight 12*a*' lie. Lever 16' can be pivoted about pivot axis P—P by the user as shown by arrow 36 in FIG. 4, and the user may angularly displace pivot axis P—P relative to dog member 12' about a point on pivot axis P—P which is the intersection of the longitudinal axis L—L of lever 16' (FIG. 4A) and pivot axis P—P. The horizontal placement of the ball and socket joint of the embodiment of FIGS. 4-4B does not permit the substantially 360 degree of rotation (angular displacement) of the pivot axis about a point on itself as is the case with the embodiment of FIGS. 1-1C, but does permit sufficient oscillation (angular displacement) of the pivot axis P—P about a point thereon to accommodate the change in orientation of dog member 12' when it undergoes its twisting, seating movement. The angular displacement of pivot axis P—P is sufficient to enable accommodation of the seating movement of dog member 12' while maintaining pivot axis P—P substantially parallel to the edge 27 of board 26*a*, the pivot axis through which lever 16' pivots thereby being kept substantially perpendicular to the edge 27 of the adjacent board 26*a*. The embodiment illustrated in FIGS. 4-4B thus provides the same advantage as the first described embodiment of FIGS. 1-1C with regard to pivoting the lever in a plane which can be chosen independently of the orientation of the dog member on the joist.

The open-ended tapped bore 34 of the embodiments illustrated in FIGS. 4-4B allows the orientation of lever 16 to be reversed, because ball post 32 can be unscrewed from one side of bore 34 on leg 13*b*' and screwed again into bore 34 from the opposite side. Therefore, dog member 12' can be reversed on joist 14*a* and lever 16 can be reversed, e.g., to accommodate the preferences of left-handed or right-handed users.

As discussed above, press plate 24' is indexable in the embodiment of FIGS. 4-4A because it is mounted on a sleeve 39 which is internally configured to receive a nut 41 (FIG. 4B), which is a hexagonal nut in the illustrated embodiment, and which is non-rotatably affixed to and coaxial with lever 16', as illustrated in FIGS. 4A and 4B. The internal surface 39*a* of sleeve 39 includes a shoulder 43 which rests on nut 41 when sleeve 39 is in place. The internal surface of sleeve 39 below shoulder 43 (FIG. 4A) is configured (as seen in FIG. 4B) to fixedly engage the outer lateral surfaces of nut 41 in a selected one of a number of rotational orientations about lever 16'. In the illustrated embodiment, this is attained by configuring internal surface 39*a* in a dodecagonal arrangement (FIG. 4B) having corner angles which are congruent with the outside corners of hexagonal nut 41. This enables indexing press plate 24' in any one of 12 equi-angular rotational orientations about lever 16', i.e., press plate 24' may be fixed at 30 degree intervals about lever 16'. Sleeve 39 may be displaced axially along lever 16' (in the direction towards handle 16*b*' as indicated by the arrow 42 in FIG. 4A) so that sleeve 39 is freed of and no longer engages nut 41. In the displaced position, sleeve 39 may be freely rotated about lever 16' and then lowered and reseated upon nut 41 with face plate 24' in a different angular orientation relative to lever 16' as shown in phantom outline in FIG. 4B. The ability to orient press plate 24' in this way allows the user to maintain press plate 24' oriented parallel to the edge of the board being pressed despite the limited angular displacement of pivot axis P—P, even when the boards are disposed diagonally with respect to the joists, in a manner similar to that shown in FIG. 3.

In an alternate embodiment, not illustrated, the interior surface of the sleeve 39 (corresponding to surface 39*a* of FIG. 4A) may be circular and nut 41 of FIGS. 4A and 4B may be replaced with a circular collar so that the sleeve (corresponding to sleeve 39 of FIGS. 4-4B) may freely rotate about the lever during use to maintain the press plate in a position parallel to, i.e., squarely engaged with, the edge of the board.

FIG. 5 illustrates yet another embodiment of the present invention comprising a board press 10" which may be similar or identical to those illustrated in FIGS. 1-1C and 4-4B except that the lever 16" which is equipped at its distal end with a handle 16*b*", is sharply bent at a point b about one-fifth to one-third of its length away from the point at which lever 16" is mounted on dog member 12". The angle a of the bend is sharp, preferably, from about 60 to 90 degrees. Preferably, lever 16" is bent so that its longitudinal axis lies substantially within the pivot plane V—V in which the lever pivots, as seen in FIG. 5A. As shown in its use environment in FIG. 5, dog member 12" is seated upon a joist 14 and is shown as pressing a plurality of boards 26*a*, 26*b*, 26*c*, etc. by imposing a pivoting force on the handle 16*b*" in the direction shown by the arrow 44 in FIG. 5 to pivot handle 16" through pivot plane V—V (FIG. 5A). The bent configuration of lever 16" enables the user to exert great pressure on the boards while retaining the handle in place, for example, by placing the operator's knee upon handle 16*b*", thus leaving both hands of the user free while the boards are held pressed into place.

While the invention has been described in detail with reference to particular embodiments thereof, it will be apparent that upon a reading and understanding of the foregoing, numerous alterations to the described embodiments will occur to those skilled in the art and it is intended to include such alterations within the scope of the appended claims.

What is claimed is:

1. A board press comprising: a dog member having spaced-apart legs dimensioned and configured to snugly straddle a joist, an elongate lever having a longitudinal axis and a contact section for engaging an edge of a board carried on the joist, and mounting means pivotably connecting the lever to one of the legs of the dog member to allow pivoting of the lever relative to the dog member about a pivot axis provided by the mounting means, the pivot axis being angularly displaceable about a point on the pivot axis, whereby the plane through which the lever is pivoted to bring the contact section to bear against a board carried on the joist may be selected independently of the orientation of the dog member on the joist.

2. The board press of claim 1 wherein the mounting means comprises a ball and socket joint.

3. The board press of claim 2 wherein the ball and socket joint is oriented so as to permit substantially 360 degrees of angular displacement of the pivot axis.

4. The board press of claim 1, claim 2 or claim 3 wherein the lever is rotatable about its own longitudinal axis.

5. The board press of claim 1 or claim 2 wherein the contact section of the lever comprises a press plate carried on the lever.

6. The board press of claim 5 wherein the press plate is pivotably mounted to the lever, allowing the press plate to pivot about a press plate pivot axis which is substantially perpendicular to the longitudinal axis of the lever.

7. The board press of claim 1 or claim 2 wherein the mounting means is connectible to opposite sides of the same leg of the dog member, whereby the lever can be selectively mounted on either side of the same leg of the dog member.

8. The board press of claim 5 wherein the press plate is rotatably mounted on the lever for rotation about the longitudinal axis of the lever.

9. The board press of claim 8 further including rotation indexing means operatively engaging the press plate with the lever, whereby the press plate can be selectively fixed in a plurality of rotational orientations about the longitudinal axis of the lever.

10. The board press of claim 1, claim 2 or claim 3 wherein the mounting means comprises a mounting stud disposed in lateral alignment with the legs of the dog member.

11. The board press of claim 1 or claim 2 wherein the legs of the dog member lie in a common plane and the mounting means comprises a mounting stud extending transversely of the plane in which the legs of the dog member lie.

12. The board press of claim 1, claim 2 or claim 3 wherein the lever is dimensioned and configured to be bent at an intermediate point along its length.

13. The board press of claim 12 wherein the lever is bent so that the entire longitudinal axis of the bent lever lies in the pivot plane through which the lever is pivoted.

14. In a board press comprising a dog member having spaced-apart legs dimensioned and configured to snugly straddle a joist, a lever having a longitudinal axis and being pivotably mounted on the dog member for pivoting of the lever about the dog member to press a board on the joist, and a press plate dimensioned and configured to engage a board disposed on the joist, the improvement comprising that the press plate is mounted on the lever for rotation about the longitudinal axis thereof, whereby, upon pivoting of the lever about the dog member, the press plate may be rotated relative to the lever to maintain the press plate oriented in relation to the board despite pivoting of the dog member relative to the joist.

15. The board press of claim 14 further including indexing means operatively connected between the press plate and the lever to releasably lock the press plate into a selected rotational position relative to the lever.

* * * * *

UNITED STATES PATENT AND TRADEMARK OFFICE

CERTIFICATE OF CORRECTION

PATENT NO. : 5,248,127

DATED : September 28, 1993

INVENTOR(S) : Richard L. Young

It is certified that error appears in the above-identified patent and that said Letters Patent is hereby corrected as shown below:

Column 3, line 27, replace "portions" with --portion--;

Column 6, line 12, between "board" and "present", insert --press 10 in place on joist 14a. The mounting means of the--;

Column 6, line 18, after "position", insert --shown in phantom outline in Figure 1C to the pressing position--;

Column 6, line 51, between "plate" and "squarely" insert --24--;

Column 8, line 19, between "FIG. 2B" and "of", insert --)--; and

Column 8, line 37, delete "posed".

Signed and Sealed this

Twelfth Day of April, 1994

Bruce Lehman

*Attest:*

BRUCE LEHMAN

*Attesting Officer*

*Commissioner of Patents and Trademarks*